United States Patent [19]

Lawrence

[11] Patent Number: 4,959,016

[45] Date of Patent: Sep. 25, 1990

[54] WEAPON TRAINING SYSTEMS

[76] Inventor: Ian R. Lawrence, 2 Main Avenue, Enfield, Middlesex, ENI 1 DA, England

[21] Appl. No.: 371,766

[22] Filed: Jun. 27, 1989

[30] Foreign Application Priority Data

Jun. 27, 1988 [GB] United Kingdom ..... 8815226

[51] Int. Cl.[5] ..... F41G 1/00

[52] U.S. Cl. ..... 434/22; 434/21; 273/312

[58] Field of Search ..... 434/1, 4, 16, 19, 21, 434/22; 273/311, 312, 310

[56] References Cited

U.S. PATENT DOCUMENTS 4,478,581 10/1984 Goda ..... 434/22
4,619,616 10/1986 Clarke ..... 434/19 X

FOREIGN PATENT DOCUMENTS 2037957 7/1980 United Kingdom ..... 434/22
2157814 10/1985 United Kingdom ..... 434/19

*Primary Examiner*—Richard J. Apley
*Assistant Examiner*—J. L. Doyle
*Attorney, Agent, or Firm*—Kinney & Lange

[57] ABSTRACT

A weapon simulator, particularly for simulating small arms, comprises a laser projector for attachment to the weapon. Firing the weapon initiates the production of a narrow, pulsed, beam by the laser, and this beam is scanned vertically downwardly while its pulse repetition frequency (PRF) is varied as a function of scan angle. The weapon/ammunition type can also be encoded in the laser pulses. The beam is received by a spatially diverse pair of detectors on the target, typically comprising a first detector having an annular entry aperture covering about 6 cm in the vertical direction, and a second detector disposed in the center of the annular entry aperture of the first. The central detector effectively determines the width of the beam, thus permitting the range from the weapon to the target to be computed from the beam width and the difference in the prf detected at the start and finish of the illumination of the first detector. The elevation angle of the weapon with respect to the target is computed from the mean prf detected by the central detector. Finally, the accuracy of aim of the weapon (i.e. whether the firing resulted in a hit or a miss) is determined from a combination of the range, the weapon elevation angle, and the weapon/ammunition type.

8 Claims, 3 Drawing Sheets prf 4 > prf 3 > prf 2 > prf 1

WEAPON TRAINING SYSTEMS

This invention relates to weapon training systems, and is more particularly but not exclusively concerned with weapon training systems for simulating the use of direct fire weapons such as rifles, light machine guns and other small arms.

One well known form of weapon training system for simulating the use of a direct fire weapon comprises a laser source adapted to be secured to the weapon and arranged to produce a relatively narrow pulsed laser beam which is directed along, or at a predetermined angle to, the boresight axis of the weapon. Upon aiming and simulated firing of the weapon towards a target, the laser beam is scanned in a predetermined pattern with respect to the boresight axis over the target and the area immediately around it. As the beam passes over the target, either a detector on the target detects the incidence of the beam and signals that the beam has been detected back to the firer of the weapon via a radio link, or a retro-reflector on the target reflects the beam back to a detector at the weapon. In either case, the range from the weapon to the target can be calculated from the time interval between the production of a given laser pulse at the weapon and the production of a radio or detector signal at the weapon indicating that that particular laser pulse was incident on the target. Thus the accuracy of the aim of the weapon during its simulated firing can be computed from a combination of the elevation of the weapon, the measured range to the target and the position of the target in the predetermined scanning pattern of the beam. Typical examples of such weapon training systems are described in our United Kingdom Patent Specifications Nos. 1 228 143, 1 451 192 and 2 174 789.

This prior art form of weapon training system provides excellent results, but can be rather complex and/or expensive when considered in the context of simulating the use of small arms. At least part of this complexity and expense is due to the necessity of providing a return path from the target to the weapon (i.e. the aforementioned radio link or retroreflection of the beam), in order to enable the range from the weapon to the target to be measured. It is therefore an object of the present invention to provide a weapon training system which avoids the necessity for this return path, while still providing realistic and useful simulation of the use of the weapon.

According to the present invention, a weapon training system for simulating the use of a weapon against a target comprises:

- a source of electromagnetic radiation adapted to be secured to the weapon, said source being arranged to produce a narrow beam of radiation which is directed generally along the aiming line of the weapon;
- means for scanning said beam in a predetermined direction transversely of said aiming line;
- means for modulating the beam at a frequency which is a function of the angular position of said beam along said scan direction; and
- detector means adapted to be secured to the target, for receiving the beam when the weapon is aimed at the target;
- wherein the detector means has an entry aperture which is extended by a predetermined amount along the direction of scan of the beam;

- and further comprising a circuit coupled to the output of the detector means and responsive to the respective modulation frequencies of the beam at the start and at the end of the illumination of the entry aperture of the detector means by the beam to compute the range from the weapon to the target.

It will be understood that the range from the weapon to the target can be computed from this relatively small difference in the detected modulation frequencies, because the difference is a function of the angle subtended by the predetermined extent of the entry aperture of the detector means at the weapon, and therefore a function of the range from the weapon to the target. Thus range can be computed at the target, without the necessity of the aforementioned return path from the target to the weapon.

In a preferred embodiment of the invention, the system further comprises a second detector means adapted to be secured to the target, the second detector means having an entry aperture whose extent along the direction of scan of the beam is substantially less than that of the firstmentioned detector means, and the circuit being coupled to the output of the second detector means and responsive to the modulation frequencies detected thereby to correct the range computation for the angular extent of the beam in the scan direction.

It will be understood that this correction is made possible because the second detector means, having an entry aperture with substantially no appreciable angular extent in the scan direction, is effectively operative (in combination with the circuit) to determine the angular extent of the beam.

Advantageously, the entry aperture of the first detector means is an annulus of predetermined diameter, and coaxially surrounds the entry aperture of the second detector means.

Preferably, the scanning means is arranged, in use, to scan the beam vertically downward from an initial orientation in which the beam is substantially aligned with the boresight of the weapon. In this case, the circuit is preferably arranged to compute the elevation of the weapon with respect to the target from the mean of the modulation frequencies detected by one of the first and second detector means, and to determine the accuracy with which the weapon was aimed at the target from the relationship between the computed elevation and the computed range.

The scanning means preferably comprises a piezoelectric member arranged to support at least that portion of the source from which the beam is emitted, and means for applying a ramp signal to the piezoelectric member so as to cause it to flex and thereby scan the beam.

The modulating means preferably comprises a variable frequency oscillator whose frequency is controlled by said ramp signal.

The invention will now be described, by way of example only,. with reference to the accompanying drawings, of which:

Figure 1:
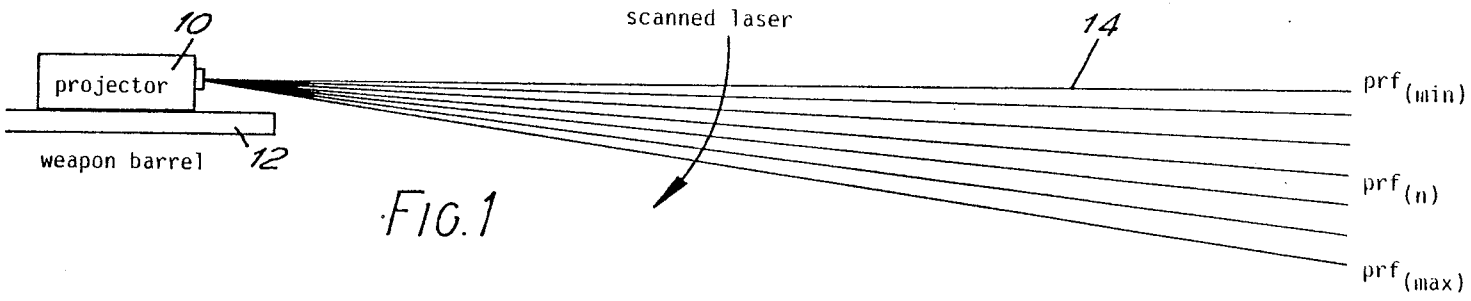
FIG. 1 shows a laser projector forming part of a weapon training system in accordance with the present invention.

The laser projector of FIG. 1 is indicated at 10, and is shown attached to the barrel 12 of a weapon such as a rifle. The laser projector 10 is arranged to produce a narrow pulsed laser beam 14, which can be scanned vertically downwardly, in use, from an initial orientation in which it is aligned with the boresight of the weapon, i.e. with the bore of the barrel 12, while having its pulse repetition frequency (or prf) increased as a function of the scan angle.

Figure 2:
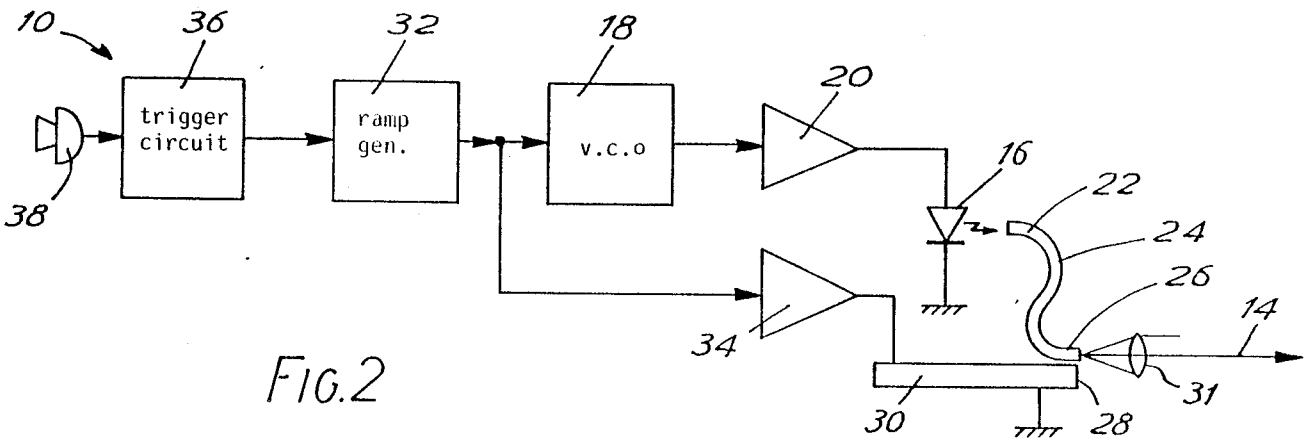
FIG. 2 shows part of the projector of FIG. 1 in a little more detail.

To this end, and as shown in FIG. 2, the projector 10 comprises a gallium arsenide laser diode 16 which is connected to be energised by a voltage-controlled oscillator (VCO) 18 via a pulse-shaping amplifier 20, so that it produces laser output pulses at the operating frequency of the oscillator 18. The laser output pulses produced by the laser diode 16 enter one end 22 of an optical fibre 24, whose other end 26 is secured to one end 28 of a piezoelectric finger 30. The exit plane of the end 26 of the fibre 24 is positioned in the focal plane of a fixed collimating lens 31, which collimates the laser pulses leaving the end 26 of the fibre and thus forms them into the aforementioned narrow pulsed laser beam 14.

The piezoelectric finger 30 is mounted within the projector 10 so that its end 28 is capable of flexing or bending vertically upwardly with respect to the remainder of the finger when a suitable DC voltage is applied to the finger. It will be appreciated that this upward flexing of the finger 30 causes the beam 14 formed by the lens 31 to be deflected vertically downwardly. The finger 30 and the lens 31 are mounted within the projector 10 such that in the relaxed or unflexed state of the finger, the beam 14 is precisely aligned with the bore of the barrel 12 of the weapon.

The operating frequency of the VCO 18 is controlled by a linear ramp generator 32, which is also connected, via a suitable amplifier 34, to control the bending or flexing of the finger 30. The ramp generator 32 is triggered into producing its output ramp by a trigger circuit 36, which is in turn triggered by a microphone 38 positioned to respond to the firing of a blank round by the weapon.

In use, the weapon, loaded with blank rounds, is aimed by its user, typically a soldier taking part in a training exercise, with a ballistic elevation appropriate to the range to the target as estimated by the user, typically up to 1000 meters, at a target equipped as will be described hereinafter. The weapon is then fired, thus firing a blank round, which triggers the ramp generator 32 via the microphone 38 and the trigger circuit 36. The ramp generator 32 starts the VCO 18, and sweeps its frequency linearly upwardly, typically from 1.1 kHz to 11 kHz over about 300 milliseconds. This energises the laser diode 16, causing it to produce the aforementioned narrow pulsed laser beam 14 from the lens 31 at the end 26 of the optical fibre 24, with a prf also varying from 1.1 kHz to 11 kHz. The ramp generator 32 simultaneously causes the end 28 of the piezoelectric finger 30 to flex progressively vertically upwardly, thus scanning the laser beam 14 produced by the lens 31 vertically downwardly at a substantially uniform angular rate, typically about 1 mrad every 15 msec, through a total of about 20 mrad in all.

Figure 3:
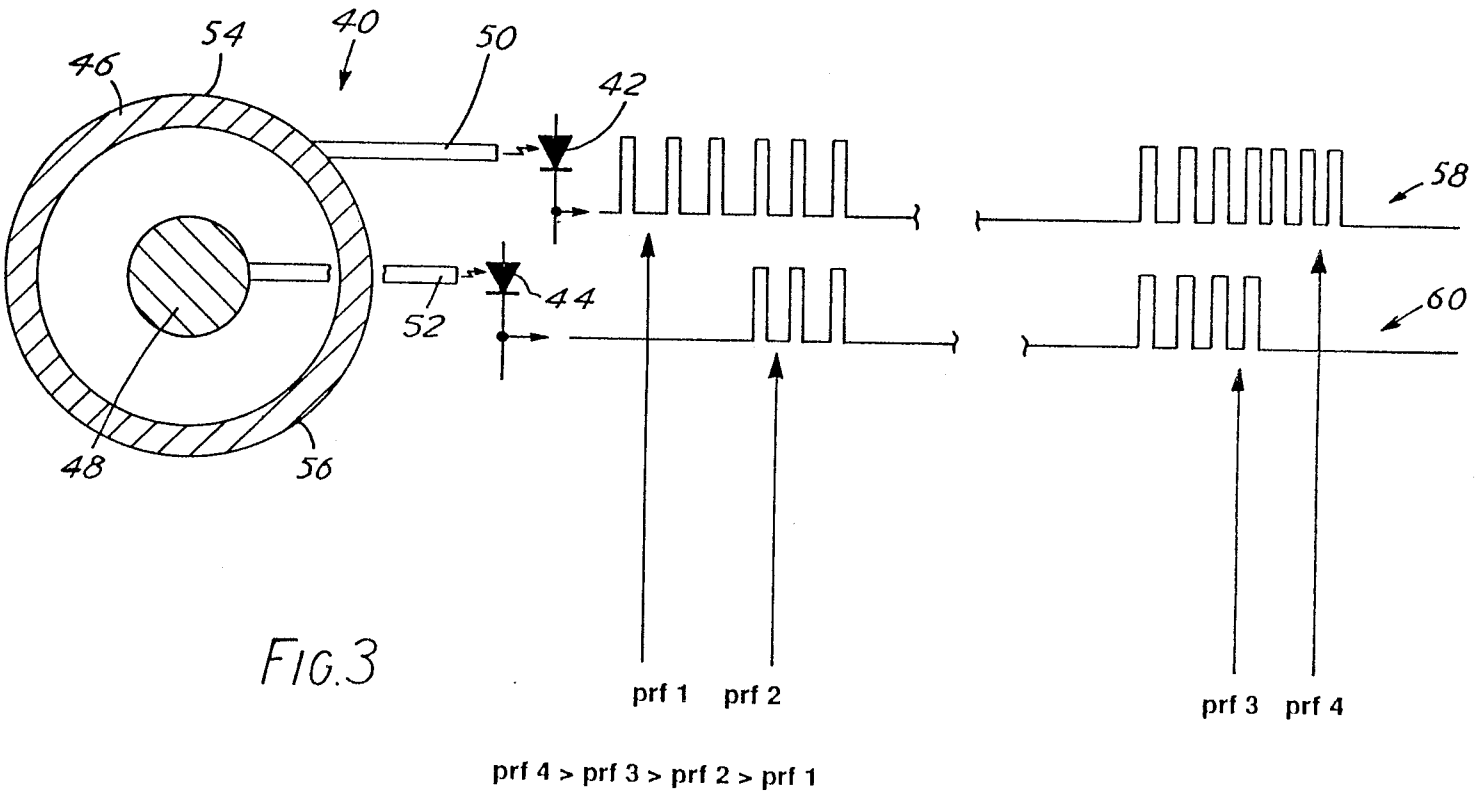
FIG. 3 shows somewhat schematically a detector unit forming a further part of the weapon training system incorporating the projector of FIGS. 1 and 2.

The target at which the weapon employing the projector 10 of FIGS. 1 and 2 is aimed is provided with at least one detector unit of the form shown somewhat schematically at 40 in FIG. 3. Typically, this target is another soldier taking part in the training exercise, wearing a harness carrying one or more of the detector units 40.

The detector unit 40 comprises first and second photoelectric detectors 42,44 having respective entry apertures 46,48. The entry aperture 46 is annular, typically about 60 mm in diameter, and coaxially surrounds the entry aperture 48. Each of the entry apertures 46,48 communicates with its respective photoelectric detector 42,44 via a respective bundle of optical fibres indicated diagrammatically at 50,52, one end of each bundle being shaped to conform to its respective entry aperture, and the other being shaped for optimum communication with its respective photoelectric detector. The detectors 42,44 are matched such that they are as equally sensitive to the incidence of the beam 14 on their respective entry apertures 46,48 as possible.

Figure 4:
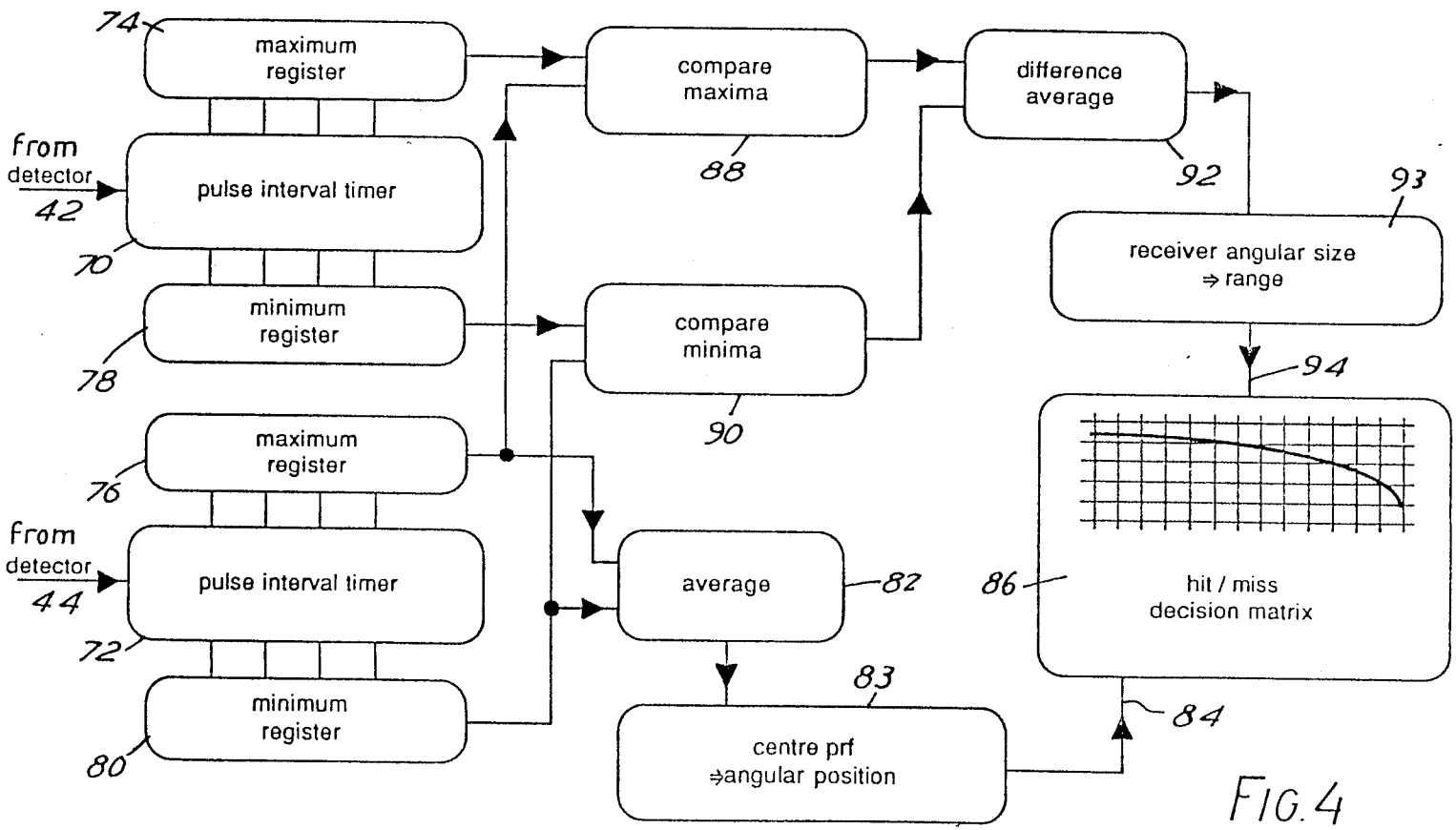
FIG. 4 is a block diagram of a circuit coupled to the detector unit of FIG. 3.

Thus as the pulsed laser beam 14 scans vertically downwardly over the detector unit 40, it will first of all be incident on the top 54 of the annular entry aperture 46 of the photoelectric detector 42, then also briefly incident on the much smaller entry aperture 48 of the photoelectric detector 44 (while still, of course, incident on the entry aperture 46), before finally leaving the bottom 56 of the annular entry aperture 46. The two photoelectric detectors 42, 44 thus produce respective output pulse trains, representative of the laser pulses incident on their respective entry apertures 46,48, as shown at 58 and 60 in FIG. 3. These pulse trains have maximum and minimum prfs indicated in FIG. 3 as prf4, prf1, and prf3, prf2, such that $$prf4 > prf3 > prf2 > prf1,$$

and are applied to the circuit of FIG. 4.

The circuit of FIG. 4 comprises first and second pulse interval timers 70, 72 connected to the respective outputs of the photoelectric detectors 42,44 respectively. Each of the pulse interval timers 70,72 measures each time interval between the leading edges of successive pulses from its respective photoelectric detector, by counting the number of clock pulses from a crystal oscillator (not shown) operating at a reference frequency of typically 15 MHz, each count being inversely proportional to the prf of the pulses over the time interval measured. The maximum count attained by each of the timers 70,72 is entered in respective registers 74,76, while the minimum count attained by each of the timers 70,72 is entered in respective registers 78,80.

The average of the maximum and minimum counts attained by the timer 72, i.e. the timer receiving the pulse train from the detector 44 having the smaller entry aperture 48 (which can effectively be regarded as a point aperture), is determined in an averaging circuit 82, and is a function of the elevation of the barrel 12 of the weapon with respect to the detector unit 40. This average is applied to a circuit 83 which computes the elevation of the barrel 12, and applies the computed value to one input 84 of comparison circuit 86. Additionally, the difference between the respective maximum counts in registers 74,76 is formed in subtraction circuit 88, the difference between the respective minimum counts in registers 78,80 is formed in subtraction circuit 90, and the difference between the respective differences in subtraction circuits 88,90 is formed in subtraction circuit 92. It can readily be shown that the difference formed in subtraction circuit 92 is representative of the angle subtended by the annular entry aperture 46 of the photoelectric detector 42 at the projector 10 on the weapon, as corrected for the angular width of the beam 14 in the scan direction, and thus a function of the range from the weapon to the target. The difference value generated by the circuit 92 is applied to a circuit 93 which computes the range from the weapon to the target, and applies the computed value to a second input 94 of the circuit 86. The circuit 86 then compares the computed range value at the input 94 with the computed elevation value at its input 84, and determines, from stored data concerning the ballistic characteristics of the weapon, the accuracy with which the weapon was aimed at the target.

If the aim is determined to be accurate, the target can be caused to emit some kind of hit signal, e.g. an audible signal or a flashing light signal, and/or disabled. Thus, if the target is another soldier wearing a harness having one or more of the detector units 40 attached thereto, and the soldier also has a weapon with a projector 10 mounted thereon, the audible signal or flashing light can be arranged to remain energised until the soldier lies down to simulate the effect of being hit, and his weapon can be disabled to prevent him from taking any further part in the training exercise. This permits realistic training exercises to be held in complete safety.

It will be appreciated that the described weapon training system has a number of advantages. In particular, the range from the weapon to the target is computed at the target, avoiding the necessity of a two-way communication link between the weapon and the target. Furthermore, the circuitry required at the target to compute the range is relatively simple digital circuitry, e.g. counters, gates, registers, subtracters, comparators, and therefore relatively inexpensive: although a microprocessor can be used, in most cases its use is not essential.

Another advantage lies in the form of the detector unit 40, in particular the annular entry aperture 46. The shape of this aperture 46 means that the detector unit 40 is wholly insensitive to rotation of the detector unit about the axis of the aperture, and relatively insensitive to small changes (up to say 30°) in the inclination of the plane of the aperture from the vertical.

Finally, the use of the detector 44 coupled to the central, substantially point, entry aperture 48 enables the system to correct for variations in the angular width of the beam 14 in the vertical direction. This is especially important in view of the fact that the laser 16 in the projector 10 has to be of relatively low power in order to be eye-safe, which means that the apparent beam width of the beam 14 can vary considerably, e.g. with weather conditions, over the operational range of the system. However, the matching of the sensitivity of the detector 44 to that of the detector 42 ensures that the detector 44 "sees" the same angular beam width as the detector 42, and is thus able to correctly compensate the angular measurement performed by the detector 42 for the angular width of the beam 14.

Many modifications can be made to the described embodiment of the invention. In particular, the weapon training system can be used to simulate the use of weapons other than rifles, e.g. light automatic weapons having a firing rate of up to say 120 rounds per minute.

Moreover, the projector 10 can be arranged to include in the emitted laser pulses extra pulses which encode, by pulse position coding, information concerning weapon and/or ammunition type. These extra coding pulses can be interleaved between the normal, already-mentioned pulses, with a timing that enables them to be readily discriminated by appropriate time-controlled gating circuitry at the target. Once discriminated at the target, the information represented by the extra coding can be used in the circuit 86 to select an appropriate set of stored ballistic data for use in the accuracy of aim determination.

Furthermore, the detector 42 with its vertically extended entry aperture 46 can be replaced by a vertical array of detectors, or even by two vertically spaced detectors, each with its own entry aperture: thus in this specification, the expression "entry aperture" as applied to one or more detectors is intended to refer to the space between the two furthest apart points in the entry or inlet to the detector or detectors which communicate with (i.e. admit light to) the detector or detectors, irrespective of whether the entire space between the points actually communicates with the detector or detectors.

Finally, although it is preferable that the entry aperture of the detector 42 be vertically extended, to cooperate with the vertical scanning of the beam 14, other orientations of the scanning of the beam and of the entry aperture of the detector 42 are possible, while still permitting the range from the weapon to the target to be computed. And if the beam width of the beam 14 is particularly well defined and known, e.g. because a relatively high power beam can be used, then the detector 44 can perhaps be omitted.

I claim:

1. A weapon training system for simulating the use of a weapon against a target, the system comprising:

a source of electromagnetic radiation adapted to be secured to the weapon, said source being arranged to produce a narrow beam of radiation which is directed generally along the aiming line of the weapon;

means for scanning said beam in a predetermined direction transversely of said aiming line;

means for modulating the beam at a frequency which is a function of the angular position of said beam along said scan direction; and detector means adapted to be secured to the target, for receiving the beam when the weapon is aimed at the target;

wherein the detector means has an entry aperture which is extended by a predetermined amount along the direction of scan of the beam;

and further comprising a circuit coupled to the output of the detector means and responsive to the respective modulation frequencies of the beam at the start and at the end of the illumination of the entry aperture of the detector means by the beam to compute the range from the weapon to the target.

2. A weapon training system as claimed in claim 1, further comprising a second detector means adapted to be secured to the target, the second detector means having an entry aperture whose extent along the direction of scan of the beam is substantially less than that of the firstmentioned detector means, and the circuit being coupled to the output of the second detector means and responsive to the modulation frequencies detected thereby to correct the range computation for the angular extent of the beam in the scan direction.

3. A weapon training system as claimed in claim 2, wherein the entry aperture of the first detector means is an annulus of predetermined diameter, and coaxially surrounds the entry aperture of the second detector means.

4. A weapon training system as claimed in claim 1, wherein the scanning means is arranged, in use, to scan the beam vertically downward from an initial orientation in which the beam is substantially aligned with the boresight of the weapon.

5. A weapon training system as claimed in claim 4, wherein the circuit is arranged to compute the elevation of the weapon with respect to the target from the mean of the modulation frequencies detected by the detector means, and to determine the accuracy with which the weapon was aimed at the target from the relationship between the computed elevation and the computed range.

6. A weapon training system as claimed in claim 2, wherein the scanning means is arranged, in use, to scan the beam vertically downward from an initial orientation in which the beam is substantially aligned with the boresight of the weapon, and wherein the circuit is arranged to compute the elevation of the weapon with respect to the target from the mean of the modulation frequencies detected by the detector means, and to determine the accuracy with which the weapon was aimed at the target from the relationship between the computed elevation and the computed range.

7. A weapon training system as claimed in claim 1, wherein the scanning means comprises a piezoelectric member arranged to support at least that portion of the source from which the beam is emitted, and means for applying a ramp signal to the piezoelectric member so as to cause it to flex and thereby scan the beam.

8. A weapon training system as claimed in claim 7, wherein the modulating means comprises a variable frequency oscillator whose frequency is controlled by said ramp signal.

* * * * *